US008109709B1

(12) United States Patent
Gaetze

(10) Patent No.: US 8,109,709 B1
(45) Date of Patent: Feb. 7, 2012

(54) REMOVABLE GRAPPLE APPARATUS FOR A LOADER BUCKET

(76) Inventor: Tom Gaetze, Sioux Falls, SD (US)

( * ) Notice: Subject to any disclaimer, the term of this patent is extended or adjusted under 35 U.S.C. 154(b) by 239 days.

(21) Appl. No.: 12/536,774

(22) Filed: Aug. 6, 2009

(51) Int. Cl.
*E02F 3/413* (2006.01)

(52) U.S. Cl. ..... 414/724; 37/406; 37/903; 414/912

(58) Field of Classification Search ..... 414/724, 414/912; 37/406, 403, 903
See application file for complete search history.

(56) References Cited

U.S. PATENT DOCUMENTS

| | | | | |
|---|---|---|---|---|
| 3,921,837 | A * | 11/1975 | Vandewater | 414/24.5 |
| 4,056,205 | A | 11/1977 | Etzler | |
| 5,094,581 | A | 3/1992 | Lamb | |
| 5,476,356 | A | 12/1995 | Weiss | |
| 6,074,160 | A * | 6/2000 | Brumbaugh et al. | 414/704 |
| D496,945 | S | 10/2004 | Daniel | |
| 7,014,412 | B2 | 3/2006 | Daniel | |
| 7,431,554 | B2 | 10/2008 | Westendorf | |
| 2001/0038790 | A1 | 11/2001 | Evans | |
| 2003/0129049 | A1 | 7/2003 | Evans | |

* cited by examiner

*Primary Examiner* — Donald Underwood
(74) *Attorney, Agent, or Firm* — Jeffrey A. Proehl; Woods, Fuller, Shultz & Smith PC

(57) ABSTRACT

A removable grapple apparatus for a loader bucket is disclosed, and comprises a grapple assembly comprising at least one grapple arm having an inboard end and an outboard end, and a grapple fork mounted on the grapple arm toward the outboard end thereof. The apparatus includes a mounting assembly configured to removably mount the grapple assembly to the bucket when the mounting assembly is mounted on the bucket. The grapple assembly is pivotally mounted on the mounting assembly to permit pivot movement of the grapple assembly with respect to the mounting assembly. The apparatus includes a grapple movement assembly configured to pivotally move the grapple assembly with respect to the mounting assembly. The mounting assembly comprises at least one mount structure including an arm mount mounted on the grapple arm and a base mount configured for mounting on the bucket, and the arm mount and the base mount are releasably coupleable together.

16 Claims, 5 Drawing Sheets

REMOVABLE GRAPPLE APPARATUS FOR A LOADER BUCKET

BACKGROUND

1. Field

The present disclosure relates to loader attachments and more particularly pertains to a new removable grapple apparatus for a loader bucket that permits the use of a grapple with virtually any bucket and allows for removal of the grapple when the grapple is not needed.

2. Description of the Prior Art

Grapple apparatus have been integrated into loader buckets by manufactures to provide grapple functionality to the bucket.

SUMMARY

In view of the foregoing, the present disclosure describes a new removable grapple apparatus for a loader bucket that permits the use of a grapple with virtually any bucket, even if not manufactured with a grapple structure, and also allows for removal of the grapple when the grapple is not needed.

The present disclosure relates to a removable grapple apparatus for a loader bucket. The grapple apparatus may comprise a grapple assembly that includes at least one grapple arm having an inboard end and an outboard end, and a grapple fork mounted on the at least one grapple arm toward the outboard end thereof. A mounting assembly is configured to removably mount the grapple assembly to the loader bucket when the mounting assembly is mounted on the bucket. The grapple assembly is pivotally mounted on the mounting assembly to permit pivot movement of the grapple assembly with respect to the mounting assembly. A grapple movement assembly is configured to pivotally move the grapple assembly with respect to the mounting assembly. The mounting assembly comprises at least one mount structure including an arm mount mounted on the grapple arm and a base mount configured for mounting on the bucket. The arm mount and the base mount being releasably coupleable together.

In another aspect, a grapple system is disclosed that comprises a loader bucket having a perimeter wall defining an opening, and the perimeter wall includes an upper wall portion terminating at a forward edge. The system also includes a grapple apparatus mounted on the loader bucket, and comprises a grapple assembly with at least one grapple arm having an inboard end and an outboard end. A grapple fork is mounted on the at least one grapple arm toward the outboard end thereof. The grapple apparatus includes a mounting assembly mounted on the perimeter wall of the bucket. The grapple assembly is pivotally mounted on the mounting assembly to permit pivot movement of the grapple assembly with respect to the mounting assembly. The grapple apparatus also includes a grapple movement assembly configured to pivotally move the grapple assembly with respect to the mounting assembly. The mounting assembly comprises at least one mount structure including an arm mount mounted on the grapple arm and a base mount configured for mounting on the bucket, The arm mount and the base mount are releasably coupleable together.

There has thus been outlined, rather broadly, some of the more important elements of the invention in order that the detailed description thereof that follows may be better understood, and in order that the present contribution to the art may be better appreciated. There are additional elements of the invention that will be described hereinafter and which will form the subject matter of the claims appended hereto.

In this respect, before explaining at least one embodiment or implementation in greater detail, it is to be understood that the scope of the invention is not limited in its application to the details of construction and to the arrangements of the components set forth in the following description or illustrated in the drawings. The invention is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present invention.

The advantages of the various embodiments of the present invention, along with the various features of novelty that characterize the invention, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
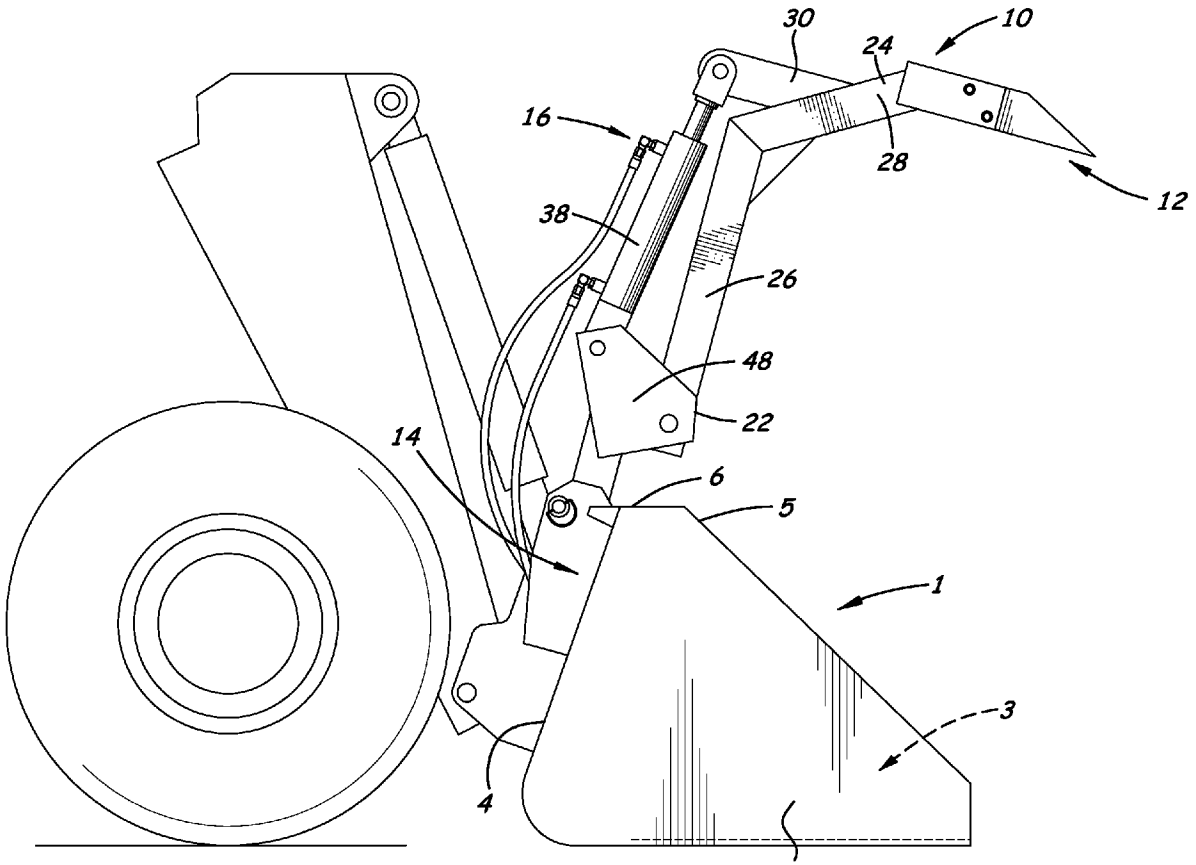
FIG. 1 is a schematic side view of a new removable grapple apparatus for a loader bucket according to the present disclosure shown mounted on a loader bucket.
Figure 2:
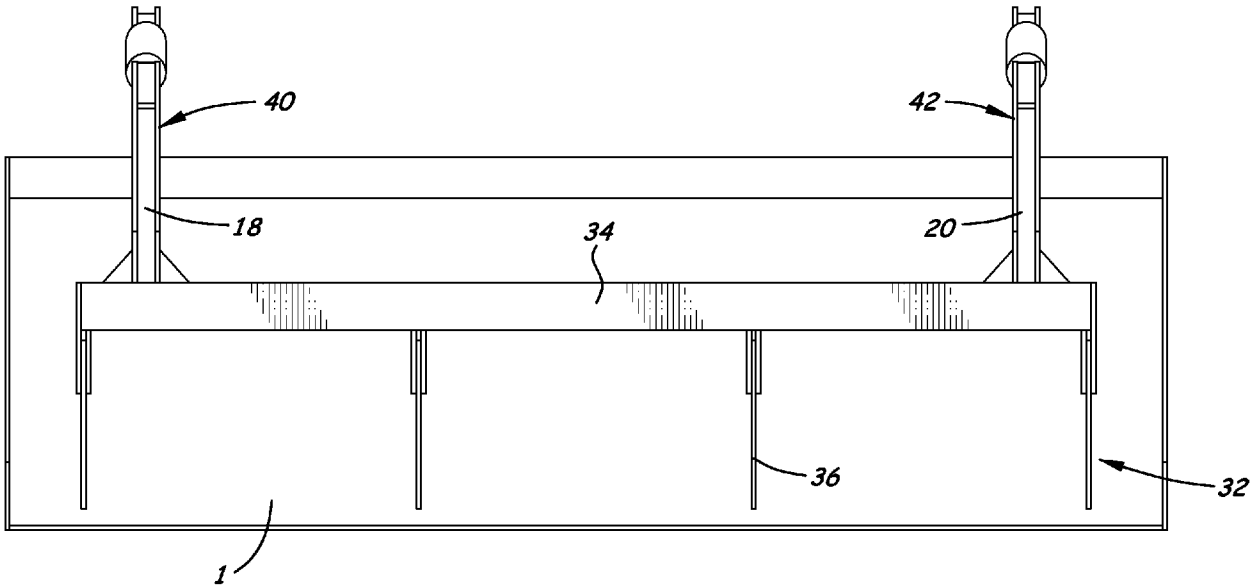
FIG. 2 is a schematic front view of the grapple apparatus, according to an illustrative embodiment, mounted on a bucket.
Figure 3:
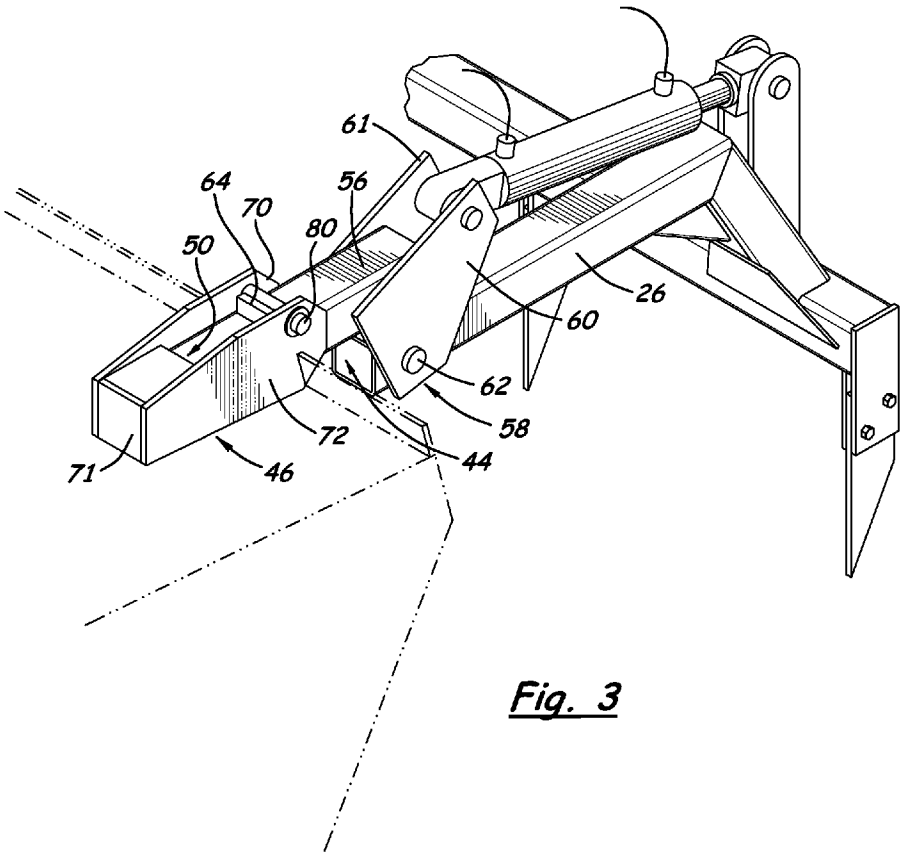
FIG. 3 is a schematic perspective view of the mounting assembly, according to an illustrative embodiment, mounted on the bucket.
Figure 4:
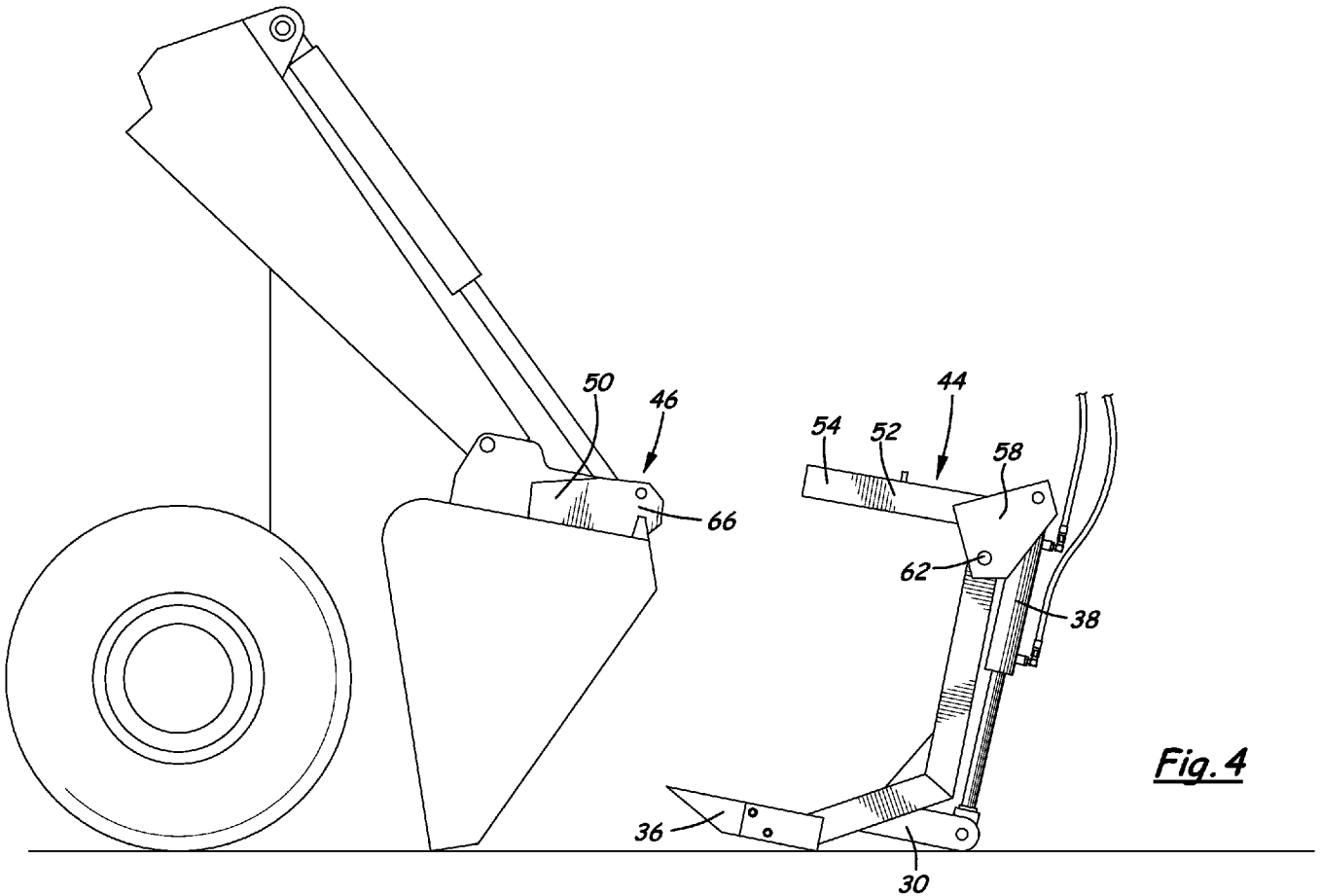
FIG. 4 is a schematic side view of the grapple assembly dismounted from the mounting assembly and bucket, according to an illustrative embodiment.
Figure 5:
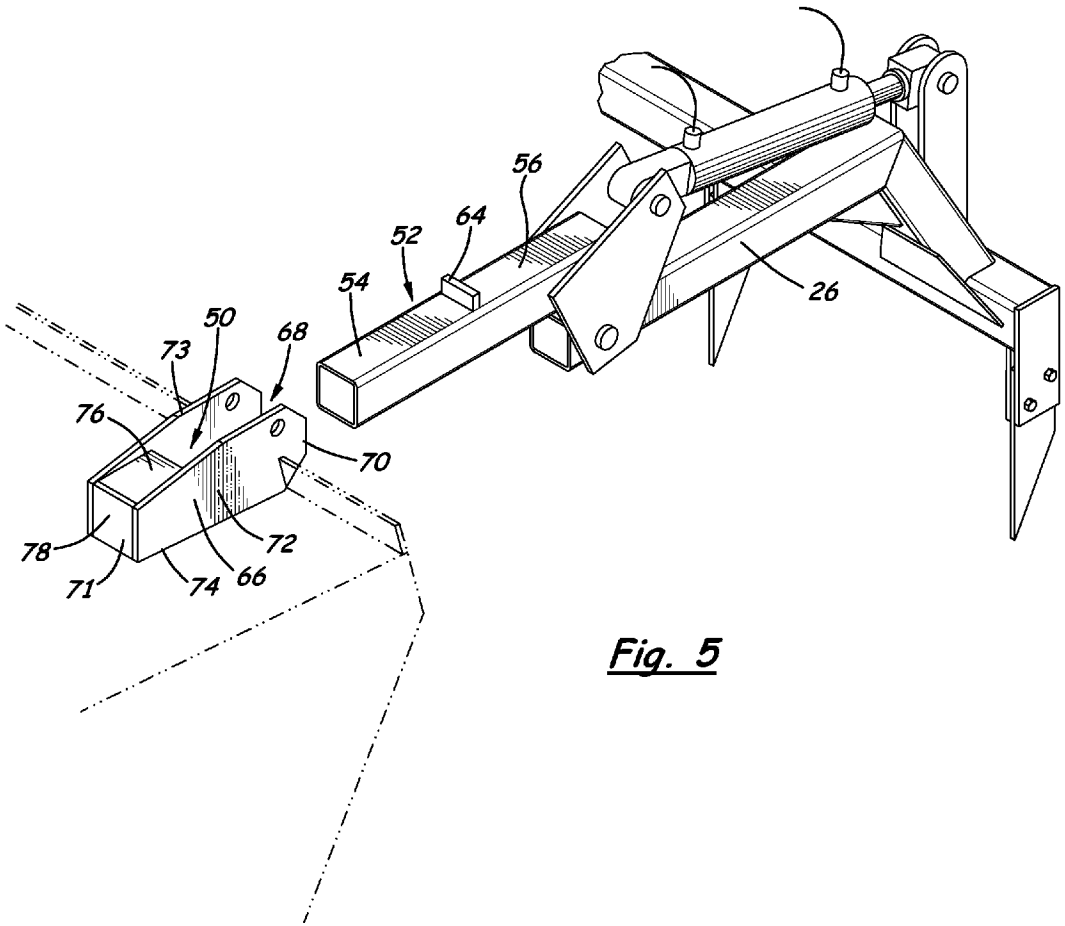
FIG. 5 is a schematic perspective view of the mounting assembly shown in a dismounted condition.

With reference now to the drawings, and in particular to FIGS. 1 through 5 thereof, a new removable grapple apparatus for a loader bucket embodying the principles and concepts of the disclosed subject matter will be described.

In one aspect of the disclosure, a removable grapple apparatus 10 for a loader bucket 1 will be described. In another aspect, a bucket and grapple system that includes the combination of the bucket 1 and the grapple apparatus 10 is disclosed. A suitable loader bucket 1 for use with the apparatus 10 (or inclusion in the system) may have a perimeter wall 2 defining an opening 3. The perimeter wall may include a plurality of wall portions that form a continuous or substantially continuous perimeter about an interior space of the bucket, with the opening providing access to the interior space. The opening may occupy the entire front, and a portion of the top of the bucket, so that the opening generally lies in a plane that is inclined rearwardly from the vertical. The perimeter wall 2 may include an upper wall portion 4 that terminates at a forward boundary or edge 5, and may have a lip 6 that extends from the forward edge 5 of the upper wall portion in an upward and/or rearward direction from the forward edge.

Generally, the grapple apparatus 10 may include a grapple assembly 12, a mounting assembly 14 for removably mounting the grapple assembly on the bucket 1, and a grapple movement assembly 16 for moving the grapple assembly 12 with respect to the mounting assembly and the bucket when the apparatus is mounted on the bucket.

In greater detail, the grapple assembly 12 of the grapple apparatus 10 may be movable with respect to the bucket when the apparatus is mounted on the bucket to help move objects into the interior of the bucket and also to hold objects in the interior of the bucket during transport of the bucket by, for example, a loader on which the bucket is mounted. The grapple assembly 12 may comprise at least one grapple arm 18, and may include a pair of grapple arms 18, 20. Each of the grapple arms may have an inboard end 22 and an outboard end 24. Each of the grapple arms 18, 20 may comprise an inboard arm portion 26 and an outboard arm portion 28. The inboard arm portion 26 may be located toward the inboard end 22 of the grapple arm, and the outboard arm portion may be located toward the outboard end 24 of the grapple arm. in some embodiments, the inboard arm portion 22 may be elongated along a first axis and the outboard arm portion 24 may be elongated along a second axis. The second axis may be oriented at a non-zero angle to the first axis, and the angle may measure between approximately 75 degrees and approximately 150 degrees.

The grapple assembly 12 may also include an outboard actuator mount 30 mounted on one of the inboard 26 and outboard 28 arm portions of the grapple arm, and in some of the most preferred embodiments is mounted on the outboard arm portion 28. The outboard actuator mount 30 may extend away from the axis of the elongated outboard arm portion, and may extend away from the bucket when the apparatus is mounted on the bucket.

The grapple assembly may further include a grapple fork 32 that is mounted on at least one of the grapple arms 18, 20, and may be mounted on and join the pair of grapple arms together. The grapple fork 32 may be mounted on the outboard arm portions 28 of the grapple arms 18, 20, and may be located toward the outboard ends 22. In some embodiments, the grapple fork 32 may comprise a joiner bar 34 mounted on the outboard arm portions 28 of the pair of grapple arms, and the joiner bar 34 may extend generally transversely to the grapple arms. The grapple fork 32 may further comprise at least one prong 36 mounted on the joiner bar, and may include a plurality of the prongs. The prongs 36 may extend forwardly from the joiner bar 34, and may each have a base end and a free end. The width of each of the prongs may taper smaller toward the free end of the prong for added gripping ability.

The mounting assembly 14 may be configured to removably mount the grapple assembly 12 to the loader bucket 1 when the mounting assembly is mounted on the bucket. The grapple assembly 12 may be pivotally mounted on the mounting assembly 14 to thereby permit pivot movement of the grapple assembly 12 with respect to the mounting assembly (and the bucket when the mounting assembly 14 is mounted on the bucket). The mounting assembly 14 may comprise at least one mount structure 40, and may include a pair of the mount structures 40, 42 for mounting on the bucket. In some embodiments, the pair of mount structures are not connected to each other than by the grapple assembly 12 and the bucket when mounted on the bucket.

Each of the mount structures 40, 42 may comprise an arm mount 44 that is mounted on the grapple arm 18 and a base mount 46 configured for mounting on the bucket 1. The arm mount 44 and the base mount 46 may be releasably coupled together, and one of the arm 44 and base 46 mounts may form a pocket 50 for removably receiving a portion of the other one of the arm and base mounts. In the illustrative embodiments, the base mount is depicted as forming the pocket 50 that receives a portion of the arm mount, but another or opposite configuration could be utilized.

The arm mount 44 of the mount structure is pivotally mounted on one of the grapple arms 18, and may be mounted on the inboard arm portion of the grapple arm, such as at the inboard end 22. In some embodiments, the arm mount 44 may comprise an insertion portion 52 that is configured for insertion into the pocket 50 formed by the base mount 46. The insertion portion 52 of the arm mount may be elongated in shape, with an insertion end 54 and a mount end 56. The arm mount 44 may further include a protrusion element 64 mounted on the insertion portion 54 and extending from the surface of the insertion portion.

The arm mount 44 may also include a coupling portion 58 that is mounted on the insertion portion 52, and may be located toward the mount end 56 of the insertion portion. The coupling portion 58 may include a pair of spaced ears 60, 61 extending from the sides of the insertion portion 52. The inboard arm portion 26 of the grapple arm may be pivotally mounted on the coupling portion 58 by a pin 62 that extends between the spaced ears 60, 61. The arm mount 44 may also comprise an inboard actuator mount 48 that is mounted on the coupling portion 58, and may including portions of the spaced ears 60, 61 of the coupling portion.

The base mount 46 defines the pocket 50 so that the pocket is located on the bucket when the base mount is mounted on the bucket. The pocket 50 may be oriented such that it opens in a forward direction with respect to the bucket when mounted, such that the pocket may receive the insertion portion 52 of the arm mount when the grapple assembly is to be mounted on the bucket. The pocket 50 may be positioned adjacent to, and in some preferred embodiments on, the upper wall portion 4 of the bucket. This mounting location permits adjustment of the location and orientation of the pocket 50 by adjusting the height and pivot orientation of the bucket, which is advantageous in the mounting and dismounting of the grapple assembly on the mounting assembly.

The base mount 46 may comprise a pocket-forming structure 66 which defines the pocket, and may also define a guide channel 68. The guide channel 68 may be oriented in alignment with the opening of the pocket 50 for receiving the insertion portion 52 of the arm mount 44. The pocket forming structure 66 may have a forward end 70 and a rearward end 72, with the pocket 50 being located toward the rearward end 71 of the pocket forming structure 66. In some embodiments, the pocket forming structure 66 may include a pair of spaced side walls 72, 73 which define the sides of the pocket 50, and may also define the sides of the guide channel 68. The pocket-forming structure 66 may further include a base wall 74 that extends between the side walls 72, 73. The base 74 and side 72, 73 walls may extend from the rearward end 71 to the forward end 70. The pocket-forming structure 66 may also include a top wall 76 that extends from the rearward end 71 of the pocket-forming structure 66 toward the forward end 70, but in some embodiments the top wall 76 does not extend completely to the forward end 70 so that the side and base walls form the guide channel 68 forward of the opening of the pocket 50 and that opens upwardly. The pocket-forming structure 66 may further include a rear wall 78 that extends between the top 76, side 72, 73 and base 74 walls to create a blind end at the rear of the pocket 50.

The mount structures 40 42 may each further include a retaining member 80 that is removably mounted on the pocket-forming structure 66 and functions to hold the insertion portion 52 in the pocket 50 when mounted on the pocket-forming structure. The retaining member 80 may comprise a pin that is removably inserted through apertures in the side walls 72, 73 of the structure 66. The apertures through which the pin 80 is inserted are suitably spaced from the base wall 74 such that the insertion portion 52 is able to be positioned below the pin 80, but the position provides insufficient clearance for the protrusion element 64 to move under the pin 80. By this positioning, the insertion portion 52 is able to fit in the guide channel 68 while the pin 80 is inserted, but the insertion portion is unable to slip out of the channel as the protrusion element is unable to move past the retaining pin 80. In some embodiments. the apertures for the retaining pin 80, the protrusion element 64, and the rear wall 78 are configured so that the rear wall and the retaining element block forward and rearward movement of the insertion portion 52 in the channel 68.

The grapple movement assembly 16 may be configured to move the grapple assembly 12 with respect to the mounting assembly 14. The grapple movement assembly 16 may be mounted on the grapple assembly and the movement assembly, and in some embodiments the grapple movement assembly is mounted on the inboard actuator mount 48 on the arm mount 44 and the outboard actuator mount 30 on the outboard arm portion, although other mounting arrangements may be employed. The grapple movement assembly 16 may move the inboard 48 and outboard 30 actuator mounts toward and away from each other to cause pivoting of the grapple assembly with respect to the mounting assembly. The grapple movement assembly 16 may comprise at least one telescopic actuator 38 having ends mounted on the mounts 30, 48, and may comprise a hydraulic ram and cylinder arrangement that is hydraulically powered by the hydraulic accessory system of the loader on which the bucket 1 is mounted. Other actuating technologies may be employed, such as, for example, a linear actuator.

In use, the grapple assembly 12 of the grapple apparatus 10 may be moved by use of the on-board hydraulic accessory control system of the loader by virtue of a releasably connection between hydraulic hoses of the grapple movement assembly 16 and supply hoses of the loader. The grapple assembly may be moved or pivoted between an open position in which the grapple fork 32 is moved away and upwardly from the opening 3 of the bucket, and a closed position in which the grapple fork extends across or in front of or even into the opening of the bucket 1. To remove the grapple apparatus from the bucket 1, the bucket may be tipped forwardly so that the grapple fork 32 and outboard arm portions 28 of the arms 18, 20 rest upon the ground surface. The retaining pin 80 may be removed from the apertures in the pocket-forming structure 66, and the bucket with the base mount 46 may be moved rearwardly with respect to the grapple assembly to withdraw the insertion portion 52 of the arm mount 44 from the pocket 50 of the pocket-forming structure 66, thereby releasing the grapple assembly from the bucket, and the bucket 1 may be used without the grapple assembly.

To reattach the grapple assembly to the bucket, the grapple assembly may be positioned as described above with the grapple fork resting on the ground surface. The bucket 1 may be tipped and raised (or lowered) into the proper orientation for the insertion portion to move into the channel, and then the bucket may be moved forwardly toward the grapple assembly by moving the loader forwardly. As the bucket moves forwardly, the operator may view the insertion portion and the pocket and make needed adjustments in the position and orientation of the bucket, and thus the pocket-forming structure. The guide channels of the pocket-forming structures may be aligned with the insertion portions 52 of the arm mounts 44, so that the forward movement moves the insertion end 54 of the insertion portion into and along the guide channel 68 until the insertion end reaches the opening of the pocket 50 and enters the pocket, with the rear wall 78 of the pocket-forming structure forming a limit to the extent that the insertion portion 52 is insertable into the pocket. The retaining pin 80 may be inserted into the apertures in the pocket-forming structure 66 to interact with the protrusion element 64 to prevent withdrawal of the insertion portion 52 from the pocket 50.

Advantageously, the grapple apparatus 10 may be implemented on a conventional loader bucket without the bucket having to be manufactured or produced together with the grapple apparatus. The grapple apparatus may thus be used on wide variety of bucket sizes, designs, configurations, by simply attaching the base mount 46 to the bucket, such as by mounting on an upper wall portion of the bucket. The grapple assembly is then easily mounted on and dismounted from the base mount and the bucket as needed.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A removable grapple apparatus for a loader bucket, the grapple apparatus comprising:

a grapple assembly comprising at least one grapple arm having an inboard end and an outboard end, and a grapple fork mounted on the at least one grapple arm toward the outboard end thereof;

a mounting assembly configured to removably mount the grapple assembly to the loader bucket when the mounting assembly is mounted on the bucket, the grapple assembly being pivotally mounted on the mounting assembly to permit pivot movement of the grapple assembly with respect to the mounting assembly; and a grapple movement assembly configured to pivotally move the grapple assembly with respect to the mounting assembly;

wherein the mounting assembly comprises at least one mount structure including an arm mount mounted on the grapple arm and a base mount configured for mounting on the bucket, the arm mount and the base mount being releasably coupleable together;

wherein the base mount comprises a pocket-forming structure and includes a retaining member removably mounted on the pocket-forming structure, and wherein the arm mount includes a protrusion element mounted on an insertion portion and protruding from a surface of the insertion portion to interact with the retaining member mounted on the pocket-forming structure to resist removal of the arm mount from the base mount.

2. The apparatus of claim 1 wherein the pocket-forming structure has a closed end opposite of the opening blocking insertion of the arm mount through the pocket.

3. The apparatus of claim 1 wherein the opening of the pocket-forming structure is spaced rearwardly from a forward end of side walls of the pocket-forming structure.

4. The apparatus of claim 1 wherein the at least one grapple arm comprises a pair of grapple arms, and the at least one mount structure includes a pair of the mount structures for mounting on the bucket, each of the grapple arms being mounted on one of the mount structures.

5. The apparatus of claim 1 wherein the arm mount is pivotally mounted on the at least one grapple arm to permit pivot movement of the grapple arm with respect to the mounting assembly.

6. The apparatus of claim 1 wherein the arm mount comprises an insertion portion configured for insertion into the pocket-forming structure of the base mount, the insertion portion being elongated with an insertion end for insertion into the pocket-forming structure.

7. The apparatus of claim 1 wherein the pocket-forming structure has a forward end and a rearward end, the pocket-forming structure including a pair of spaced side walls defining sides of the guide channel and sides of the pocket-forming structure.

8. The apparatus of claim 7 wherein the pocket-forming structure further includes a base wall extending between the side walls, the base and side walls extending from the rearward end to the forward end, the pocket forming structure also including a top wall extending from the rearward end of the pocket-forming structure toward the forward end, the top wall not extending completely to the forward end of the side walls.

9. The apparatus of claim 1 further comprising means for releasably locking the arm mount and the base mount together.

10. The apparatus of claim 1 wherein the at least one grapple arm includes an inboard arm portion located toward the inboard end of the grapple arm and an outboard arm portion located toward the outboard end of the grapple arm;

wherein the inboard arm portion is elongated along a first axis and the outboard arm portion being elongated along a second axis, the second axis being oriented at a non-zero angle to the first axis.

11. The apparatus of claim 1 wherein the grapple movement assembly comprises a telescopic actuator mounted on an inboard actuator mount on the mounting assembly and an outboard actuator mount mounted on the grapple assembly.

12. The apparatus of claim 1 wherein the grapple fork comprises a joiner bar mounted on the outboard end portion of the grapple arm and extending generally transverse to the grapple arm; and a plurality of prongs mounted on the joiner bar.

13. A grapple system, comprising:

a loader bucket having a perimeter wall defining an opening, the perimeter wall including an upper wall portion terminating at a forward edge; and a grapple apparatus mounted on the upper wall portion of the loader bucket, the grapple apparatus comprising:

a grapple assembly comprising at least one grapple arm having an inboard end and an outboard end; and a grapple fork mounted on the at least one grapple arm toward the outboard end thereof;

a mounting assembly mounted on the perimeter wall of the bucket, the grapple assembly being pivotally mounted on the mounting assembly to permit pivot movement of the grapple assembly with respect to the mounting assembly; and a grapple movement assembly configured to pivotally move the grapple assembly with respect to the mounting assembly;

wherein the mounting assembly comprises at least one mount structure including an arm mount mounted on the grapple arm and a base mount configured for mounting on the bucket, the arm mount and the base mount being releasably coupleable together.

wherein the base mount includes a pocket-forming structure with a forward end and a rearward end, the pocket-forming structure forming a pocket toward the rearward end with an opening into the pocket and the pocket-forming structure also forming a guide channel toward the forward end that extends forwardly from the pocket opening to receive an insertion portion of the arm mount and guide movement of the insertion portion toward the opening of the pocket;

wherein the pocket-forming structure includes a base wall extending from the rearward end to the forward end of the pocket-forming structure and a pair of spaced side walls on sides of the base wall to define sides of the pocket and the guide channel to align the guide channel with the opening of the pocket; and wherein the pocket forming structure includes a top wall extending from the rearward end of the pocket-forming structure toward the forward end and terminating short of the forward end such that the guide channel has an open top located forward of the opening of the pocket, the open top being configured to receive an end of the insertion portion of the arm mount at any location between the forward end of the pocket-forming structure and the opening of the pocket to guide the insertion portion toward and into the pocket;

wherein the base mount includes a retaining member removably mounted on the pocket-forming structure, and wherein the arm mount includes a protrusion element mounted on the insertion portion and protruding from a surface of the insertion portion to interact with the retaining member mounted on the pocket-forming structure to resist removal of the arm mount from the base mount.

14. The system of claim 13 wherein the arm mount comprises an insertion portion configured for insertion into the pocket-forming structure of the base mount, the insertion portion being elongated with an insertion end for insertion into the pocket-forming structure.

15. The system of claim 13 wherein the pocket has a tubular shape and the guide channel has a U-shape.

16. The system of claim 13 wherein the pocket has a longitudinal length between the rearward end of the pocket-forming structure and the opening of the pocket, and the guide channel has a longitudinal length between the forward end of the pocket-forming structure and the opening of the pocket, and the longitudinal length of the guide channel is greater than the longitudinal length of the pocket.

* * * * *